US011035083B2

(12) United States Patent
van der Wende et al.

(10) Patent No.: US 11,035,083 B2
(45) **Date of Patent: *Jun. 15, 2021**

(54) SUPPORT LAYER FOR SUPPORTING AN ARTIFICIAL TURF ASSEMBLY, AND ARTIFICIAL TURF SYSTEM

(71) Applicants: Synprodo B.V., Wijchen (NL); Saltex Oy, Alajarvi (FI)

(72) Inventors: Anjo Antonius Johannes van der Wende, Wijchen (NL); Dave Johannes Hendrikus Petrus Gijsberts, Wijchen (NL); Petrus Antonius Maria De Bruijn, Wijchen (NL)

(73) Assignees: SYNPRODO B.V., Wijchen (NL); SALTEX OY, Alajarvi (FI)

( * ) Notice: Subject to any disclaimer, the term of this patent is extended or adjusted under 35 U.S.C. 154(b) by 0 days.

This patent is subject to a terminal disclaimer.

(21) Appl. No.: 16/892,915

(22) Filed: Jun. 4, 2020

(65) Prior Publication Data

US 2020/0299907 A1 Sep. 24, 2020

Related U.S. Application Data

(63) Continuation-in-part of application No. 16/523,370, filed on Jul. 26, 2019, now Pat. No. 10,774,481, (Continued)

(30) Foreign Application Priority Data

Mar. 23, 2017 (NL) ..... 2018565

(51) Int. Cl.
*E01C 13/02* (2006.01)
*E01C 13/08* (2006.01)
(Continued)

(52) U.S. Cl.
CPC ..... *E01C 13/083* (2013.01); *E01C 3/006* (2013.01); *E01C 13/02* (2013.01); *E01C 13/045* (2013.01);
(Continued)

(58) Field of Classification Search
CPC combination set(s) only.
See application file for complete search history.

(56) References Cited

U.S. PATENT DOCUMENTS 8,221,856 B2 7/2012 Stroppiana
8,225,566 B2 7/2012 Prevost et al.
(Continued)

FOREIGN PATENT DOCUMENTS

CN 105887623 A 8/2016
CN 205893861 U 1/2017
(Continued)

OTHER PUBLICATIONS

Dutch Search Report dated Mar. 29, 2017 for NL 2018565 (7 pages).
(Continued)

*Primary Examiner* — Kyle Armstrong
(74) *Attorney, Agent, or Firm* — Shumaker, Loop & Kendrick, LLP

(57) ABSTRACT

A support layer for supporting an artificial turf assembly. The support layer being formed of a polymeric foam, preferably having a density of between 20 and 70 grams per liter, such as a polyolefin foam; and having an upper side and a lower side, wherein in use the support layer has been placed with the lower side thereof on a base surface and supports, on the upper side thereof, the artificial turf assembly, the support layer including a plurality of through drainage holes extending from the upper side to the lower side for allowing liquid such as rain water to flow via the
(Continued)

plurality of drainage holes from the upper side to the lower side, and also including a plurality of channels at the lower side for allowing liquid such as rain water to flow through the channels along the lower side, wherein each of said plurality of drainage holes debouches into one of the plurality of channels. The support layer is further included in an artificial turf system, that includes an artificial turf assembly with the support layer supported on a base surface such as a layer of sand, wherein the support layer forms, at the upper sides thereof, a closed support surface supporting the artificial turf assembly.

26 Claims, 7 Drawing Sheets

Related U.S. Application Data which is a continuation of application No. 15/934,050, filed on Mar. 23, 2018, now Pat. No. 10,400,399.

(51) Int. Cl.
*E01C 3/00* (2006.01)
*E01C 13/04* (2006.01)

(52) U.S. Cl.
CPC ..... *E01C 2201/10* (2013.01); *E01C 2201/14* (2013.01); *E01C 2201/207* (2013.01)

(56) References Cited

U.S. PATENT DOCUMENTS

| | | | | |
|---|---|---|---|---|
| 9,394,702 | B2 * | 7/2016 | Cormier | E01C 13/02 |
| 10,400,399 | B1 | 9/2019 | van der Wende et al. | |
| D866,800 | S * | 11/2019 | Runkles | D25/138 |
| 2005/0223666 | A1 * | 10/2005 | Forster | E04F 15/16 52/392 |
| 2009/0162579 | A1 * | 6/2009 | McDuff | E01C 13/08 428/17 |
| 2013/0101777 | A1 | 4/2013 | Sawyer et al. | |
| 2013/0102403 | A1 | 4/2013 | Vachon | |
| 2017/0335524 | A1 | 11/2017 | Sawyer et al. | |
| 2019/0345676 | A1 | 11/2019 | van der Wende et al. | |

FOREIGN PATENT DOCUMENTS

| | | | |
|---|---|---|---|
| EP | 2154291 | A1 | 2/2010 |
| NL | 1029940 | C1 | 3/2007 |
| WO | 2017211183 | A1 | 12/2017 |

OTHER PUBLICATIONS

European Search Report dated Aug. 15, 2018 for EP 18163740 (2 pages).

* cited by examiner

SUPPORT LAYER FOR SUPPORTING AN ARTIFICIAL TURF ASSEMBLY, AND ARTIFICIAL TURF SYSTEM

TECHNICAL FIELD

The present invention relates to a support layer for supporting an artificial turf assembly, and to an artificial turf system. The support layer of the present invention may be used as supporting layer for artificial turf systems, for example for use in athletic fields (e.g. soccer fields), for equestrian applications, in ornamental lawns and gardens, and in children's playgrounds.

BACKGROUND

Artificial turf is widely used for athletic fields/courses for playing sports such as soccer, field hockey, football, rugby, golf, etc., and for playgrounds as well as for equestrian use. An artificial turf system is known and it typically buildup of a base layer or foundation layer (e.g. compacted sand or dirt, concrete, asphalt, gravel, or other compacted particulate or granulate material; said foundation layer being graded so that water will not form pools on the field), a support layer (e.g. according to the present invention) and the artificial turf (comprising a porous turf backing to which a plurality of plastic grass-like filaments/strands are attached, preferably comprising an infill material between approx. the lower half to two-third of the vertically arrange filaments).

SUMMARY

In an aspect, the invention relates to a support layer, for supporting an artificial turf assembly. Said support layer has been formed of a polymeric foam, preferably having a density of between 20 and 70 gram per liter, such as a polyolefin foam; and has an upper side and a lower side. In use the support layer has been placed with the lower side thereof on a base surface and supports, on the upper side thereof, the artificial turf assembly. The support layer comprises a plurality of through drainage holes extending from the upper side to the lower side for allowing liquid such as rain water to flow via the plurality of drainage holes from the upper side to the lower side, and also comprises a plurality of channels at the lower side for allowing liquid such as rain water to flow through the channels along the lower side, wherein each of said plurality of drainage holes debouches into one of the plurality of channels. In certain aspects, at least partial drainage holes may be formed on peripheral edges of the support layer that form complete drainage holes when one support layer is assembled and/or connected to another support layer. These partial drainage holes being configured to direct water from an upper side of the support layer to a lower side of the support layer. An effect of the support layer according to the invention is the provision of shock absorption and dewatering to the artificial turf covering said support layer thereby improving safety and user-friendliness for users of said artificial turf. In an embodiment the support layer may have been formed as a plate element, preferably being a rectangular plate element. Alternatively the support layer may be provided on a roll.

In an embodiment the plurality of channels extend mutually parallel and are fluidly connected to each other by means of a plurality of cross channels. This way, any liquid such as rain water may easily flow along the lower side of the layer.

The plurality of cross channels may have a smaller cross sectional area than the plurality of channels, the plurality of cross channels preferably having a smaller width and/or a smaller depth than the plurality of channels.

In an embodiment the plurality of channels extend in a length direction, the plurality of cross channels extending, mutually parallel, at an angle in the range of 20 to 90 degrees, preferably from 20 to 60 degrees, more preferably from 30 to 50 degrees, to the length direction.

In an embodiment the support layer comprises a plurality of individual elevated portions and/or sloped portions formed on the upper side of the support layer that are angled towards one or more the drainage holes. An effect of the elevated portions and/or sloped portions is an improved drainage of liquid to the individual drainage holes.

The plurality of elevated portions may be dome, pyramid, truncated pyramid, cone, truncated cone or tetrahedron shaped. They preferably are pyramid shaped.

Each of the plurality of elevated portions may have at least three of the plurality of drainage holes along the circumference thereof preferably wherein each of the elevated portions has a triangular or quadrilateral shape, in plan view, wherein a drainage hole is present at each of the corners of said shape. Each of the plurality of elevated portions preferably has a quadrilateral shape, further preferably square shape, in plan view, wherein a drainage hole is present at each of the four corners of said quadrilateral shape.

The plurality of drainage holes are provided in parallel rows extending in a first direction, the holes in each of the rows being spaced apart at a constant pitch, so as to define an area between each at least three directly adjacent drainage holes, preferably between four directly adjacent holes, wherein an elevated portion of the plurality of elevated portions is formed on each area.

Each two adjacent drainage holes in neighbouring rows may be spaced apart at a distance, wherein said distance is equal to the pitch, defining a square area between four directly adjacent drainage holes, which area is thus covered by one of the elevated portions.

Drainage holes, preferably each drainage hole, of the plurality of drainage holes may have a widened entrance portion at the upper side of the support layer. As a result, drainage of liquid at the upper side of the support element is improved. In an embodiment the widened entrance portion is star-shaped or cross-shaped in plan view, each arm of the shape being sloped, that means gradually sinks into the support layer from a free end of the arm towards the hole. In certain aspects, each arm of one widened entrance portion is spaced apart and discontinuous relative to another arm of another widened entrance portion. In certain aspects, arms from each entrance portion are axially aligned with arms from another entrance portion(s) but are spaced apart and are not fluidly connected to one another on the upper side of the support layer.

In an embodiment at least two of the arms extend in line with the direction of extension of the rows. In case of a cross-shaped entrance portion preferably the remaining two arms extend perpendicular to the direction of extension of the rows. In case of rectangular or square elevated portions, the arms thus each extend in between a part of the circumference of two respective adjacent elevated portions.

An elevation of each of the plurality of elevated portions may be in the range of 1 to 5 mm. A maximum thickness of the support layer may be in the range of 10 to 80 mm, in the range of 10 to 70 mm, in the range of 15 to 70 mm, in the range of 10 to 65 mm, in the range of 15 to 65 mm, 10 to 60 mm, 15 to 60 mm, 10 to 55 mm, 15 to 55 mm, 10 to 50 mm, 15 to 50 mm, 10 to 45 mm, 15 to 45 mm, such as between 20 and 80 mm, such as between 20 and 65 mm, such as between 20 and 55 mm, such as between 20 and 45 mm, wherein any of the endpoints falling within the above disclosed ranges may serve as endpoints for any additional range(s) falling there between (but not explicitly disclosed above). A depth of the plurality of channels may be in the range of 25 to 75 percent of a total thickness of the support layer, preferably in the range of 30 to 50 percent. Said polymeric foam may have a material density of between 20 and 70 gram per liter, preferably between 30 and 50 gram per liter. In case that the support layer is in the form of a plate element, the surface area in plan view of the support plate element is in the range of 0.5 to 4 $m^2$, preferably wherein the plate element is rectangular having a length in the range of 0.5 to 4 m and a width in the same range, the length further preferably in the range of 1 to 2 m, still further preferably about 1.6 m, the width further preferably in the range of 1 to 1.5 m, still further preferably about 1.15 m.

Said polymeric foam may be a polyolefin foam, preferably a polyethylene foam (expanded polyethylene) or polypropylene foam (expanded polypropylene) or a mixture thereof. The polymer of the foam may be a homopolymer, e.g. a homo-polypropylene or a homo-polyethylene, or it may be a co-polymer, e.g. a copolymer of ethylene and propylene. Mixtures of homopolymers and/or co-polymers may also be envisaged. In addition, mixture of the same type of polymer may be used having a different density, for example a first EPP having a first density and a second EPP having a second density. Other examples of suitable materials are expanded polylactic acid (EPLA), expanded polystyrene (EPS) and mixture of all of these. The materials for use in the support layer according to the present invention may be so-called virgin (new) materials or may be recycled materials. Mixture of virgin and recycled materials may also be used. Any combination of type of polymer, density of polymer and origin (virgin versus recycled) may be used. In other words, said polymeric foam may be a polyolefin foam, preferably a polyethylene foam (expanded polyethylene EPE), polypropylene foam (expanded polypropylene EPP), polylactic acid foam (expanded polylactic acid EPLA), polystyrene foam (expanded polystyrene EPS), co-polymer foam comprising at least monomers, preferably ethylene and propylene, or one or more mixtures of these polymeric foams.

The support layer may have connecting elements at a circumferential edge thereof for connecting the support layer to further support layers such that the support layers are flush with respect to each other, preferably wherein the connecting elements are arranged for connecting the layer to a further layer in a form-closed manner such as a dovetail joint. This way, a large area may be covered by a plurality of support layers, preferably being in the form of plate elements, which plurality of support layers are effectively connected to each other.

The invention also relates to an artificial turf system, comprising an artificial turf assembly, a support layer according to the invention, preferably said support layer being in the form of a plurality of panel elements as described above, supported on a base surface such as a layer of sand, wherein the (plurality of panel elements of the) support layer forms, at the upper sides thereof, a closed support surface supporting the artificial turf assembly.

Embodiments of the support layer according to the invention as described above are also applicable for the artificial turf system according to the present invention.

BRIEF DESCRIPTION OF DRAWINGS

The present invention is described hereinafter with reference to the accompanying drawings in which an embodiment of the present invention is shown and in which like reference numbers indicate the same or similar elements.

DETAILED DESCRIPTION

Figure 1:
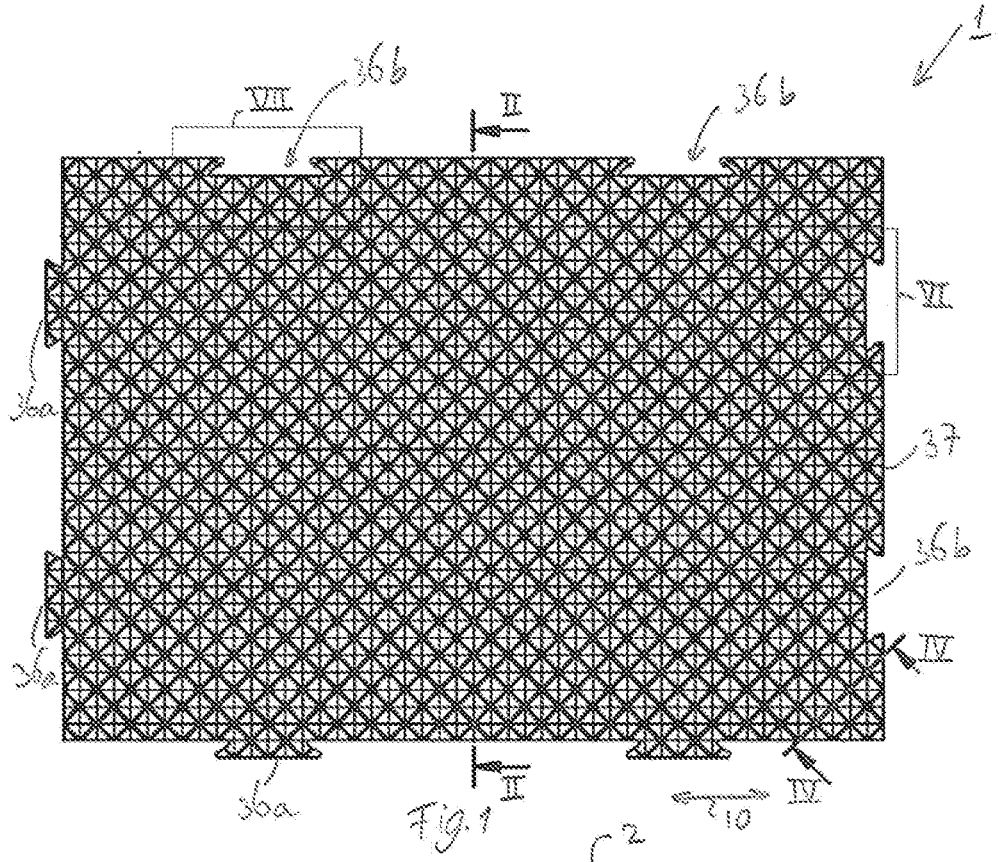
FIG. 1 shows, in plan view, an embodiment of a support layer according to the present invention.
Figure 2:
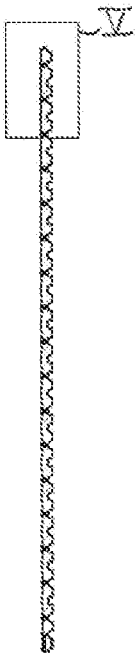
FIG. 2 shows section II-II of FIG. 1.

FIGS. 1-10 and 12 show a support layer 1 according to the invention. The support layer is arranged for supporting an artificial turf assembly 30 in use. The support layer 1 is in that case part of a plurality of such support layers 1 of a support system 50 according to FIG. 11, the system 50 further comprising an artificial turf assembly 30, that means, an assembly forming a surface of synthetic fibers made to look like natural grass, most often used in sports arenas but for residential lawns as well. The plurality of support layers 1 is then supported on a base surface 32 such as a layer of sand, and form, at upper sides 2 thereof, a closed support surface supporting the artificial turf assembly 32.

The support layer 1 is in the form of a rectangular support plate element formed of a polymeric foam and has an upper side 2 and a lower side 3, wherein, as mentioned, in use the support layer 1 has been placed with the lower side 3 thereof on a base surface and supports, on the upper side 2 thereof, the artificial turf assembly. At least in the present example, a length of the layer 1 is about 1.6 m and a width about 1.15 m.

The support layer is prepared from a polymer foam, preferably from expandable polyolefin beads that are expansion molded to provide the support layer. In an embodiment, the support layer consists of one or more expanded polypropylene (EPP) and/or one or more expanded polyethylene (EPE) materials or other materials. Co-polymeric foams may also be used as (part of) the polymeric foam. In addition, mixture of the same type of polymer may be used having a different density, for example a first EPP having a first density and a second EPP having a second density. Other examples of suitable materials are expanded polylactic acid (EPLA), expanded polystyrene (EPS) and mixture of all of these. The materials for use in the support layer according to the present invention may be so-called virgin (new) materials or may be recycled materials. Mixture of virgin and recycled materials may also be used. Any combination of type of polymer, density of polymer and origin (virgin versus recycled) may be used.

With "consists of" is meant consists for at least 90 wt. %, more preferably at least 95 wt. % of said expanded polymer. Other constituents may be for example fillers, colorant, stabilizers and other additives known to a person skilled in the art. The polymeric foam is preferably a so-called closed cell foam. The method of expansion molding using a closed mold under pressure is known in the art and will not be further explained here; usually steam is used to expand the polymeric beads which are optionally provided with an adhesive coating.

The support layer 1 comprises a plurality of through drainage holes 6 extending from the upper side 2 to the lower side 3 for allowing liquid such as rain water to flow via the plurality of drainage holes 6 from the upper side 2 to the lower side 3. The drainage holes 6 are evenly distributed over the support layer 1. At least in the present example a diameter of the holes is about 4 mm but may alternatively be in the range 1 to 20, preferably 3 to 10 mm.

The through drainage holes ensure that water, e.g. due to rain, is drained and removed from the artificial grass surface. The structure of the through drainage holes having widened entrance portion also ensures that any infill that is washed out will be trapped. The size and frequency of the drainage holes may be selected depending of the desired water extraction rate, which depends on the expected maximum rain fall in a certain geographical area where the support layer is to be used.

The support layer 1 also comprises a plurality of channels 4 at the lower side 3 for allowing liquid such as rain water to flow through the channels 4 along the lower side 3. A depth d of the channels is about 50 percent of a total thickness t of the layer 1.

The channels provided at the lower surface of the support layer preferably line up over the full length and width of the ground covering support structure allowing water to run to the sides of the field. This efficient water draining by water flow in the channels at the bottom side of the support layer is increased by a slope of e.g. 0.5% in the height of the base layer towards the sides of the filed in the same orientation as the channels.

Each of the drainage holes 6 debouches into one of the channels 4. The channels 4 extend mutually parallel over the entire lower side 3 of the support layer 1 and are fluidly connected to each other by means of a plurality of cross channels 8. The cross channels have a width which is about 50 percent of the width of the channels 4 and have a depth which is about 50 percent of the depth of the channels 4. See FIG. 5. The channels 4 extend in a length direction 10, whereas the cross channels 8 extends, also mutually parallel, at an angle $\alpha$ of about 35 degrees to the length direction 10, over the entire lower side 3 of the support layer 1.

The support layer also has a plurality of individual—preferably pyramid shaped—elevated portions 14 at the upper side 2. The elevated portions of the support layer provide improved drainage of the support layer by sloping towards the holes. The drainage holes 6 are provided in parallel rows 12 extending in a first direction 15, at 45 degrees to the length direction 10. The holes 6 in each of the rows 12 are spaced apart at a constant pitch p of about 42 mm, so as to define an area 13 between each four directly adjacent drainage holes 6. Also, each two adjacent drainage holes 6 in neighbouring rows 12 are spaced apart at a distance r of about 42 mm, wherein the distance r is thus equal to the pitch p, thereby defining a square area 13 between four directly adjacent drainage holes 6. See FIGS. 6 and 7. Each time an elevated portion 14 is formed on one of the areas 13. Thus, each elevated portion 14 has four drainage holes 6 along the circumference thereof, wherein a drainage hole 6 is present at each of the corners of said shape, except for some further elevated portions 14' at the sides of the layer.

Figure 3:
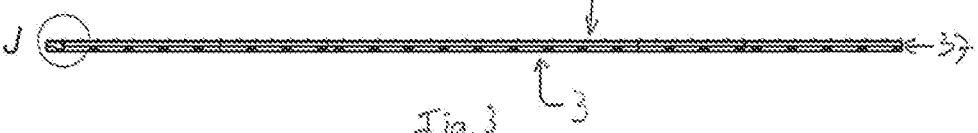
FIG. 3 shows a front view of the layer of FIG. 1.
Figure 4:
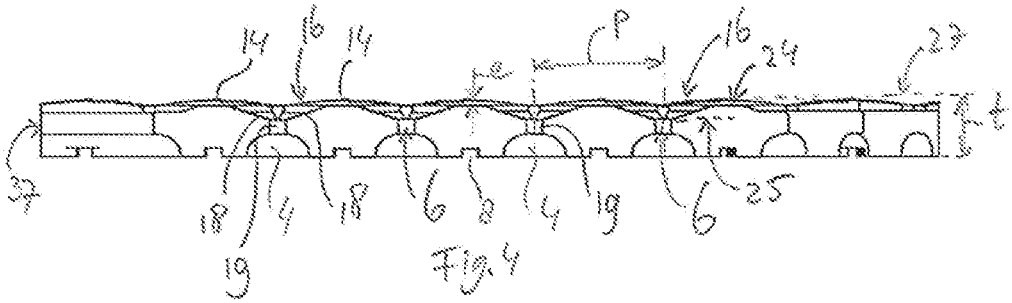
FIG. 4 shows section IV-IV of FIG. 1.
Figure 5:
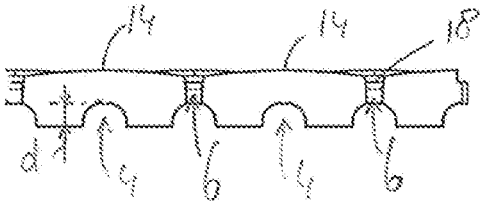
FIG. 5 shows detail V of FIG. 2.
Figure 6:
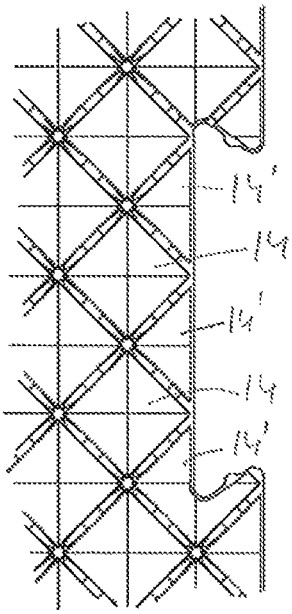
FIG. 6 shows detail VI of FIG. 1.
Figure 7:
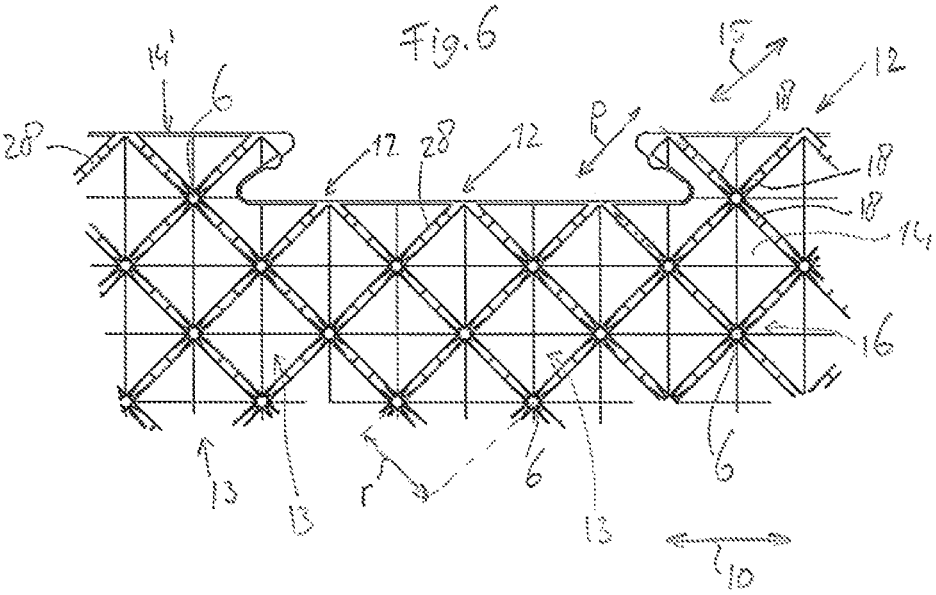
FIG. 7 shows detail VII of FIG. 1.

As in particular shown in FIGS. 3 and 4, each drainage hole has a widened entrance portion 16 at the upper side 2 of the support layer 1, to facilitate drainage to a larger extent. The widened entrance portion 16 is cross-shaped in plan view. The cross shape has four arms 18, each arm 18 being sloped, as shown in FIG. 4. As the figures show, two of the arms 18 extend in line with the direction of extension 15 of the rows 12, while the remaining two arms 18 extend perpendicular to direction 15. Below the entrance portion 18, the holes 6 have a main portion 19 which is of circular cross section but which may alternatively be of other cross sectional shapes such as square, oval or triangular, for example.

In an embodiment of the present invention, the widened entrance portion has a width of between 3 and 6 mm, preferably between 4 and 5 mm, such as between 4.2 and 4.8 mm.

In an embodiment of the present invention, the widened entrance portion has an angle with respect to the surface of the upper side of between 140° and 180°, preferably between 150° and 170°, such as between 160° and 165°.

The special effect of drainage holes with widened entrance portions is that these allow for an improved drainage as compared with holes not having these widened entrance portions; this without negatively affecting properties, such as shock absorption of the support layer.

Moreover, in a support layer having a plurality of individual elevated portions 14 at the upper side 2 and drainage holes with widened entrance portions, the elevated portions have a double function; i.e. water drainage to the drainage holes and uniform shock absorption in the support layer.

A support layer being formed of expanded polypropylene EPP and having pyramid shaped elevated portions 14 at the upper side 2, in which each drainage hole has a widened entrance portion 16 at the upper side 2 of the support layer, was tested according to the European Synthetic Turf Organisation (ESTO) Performance Guide for Shockpads. The results can be seen in the following table.

The widened entrance portion 16 has a width of 4.5±1 mm and an angle with respect to the surface of the upper side 2 of 161.6°±5%.

TABLE 1

| Property | Test Condition | Result | Requirement ESTO Guide |
|---|---|---|---|
| Thickness (mm) | EN 9863-1 | 23.4 | ≥8 mm |
| Mass (g/m$^2$) | EN 9863-1 | 885 | — |
| Density (g/L) | Calculated from mass | 38 | |
| Shock Absorption Triple A-(%) | Individual result Dry at 23 ± 2° C. | 69.1 | ≥25% |
| | Individual result Frozen | 69.1 | — |
| Vertical Deformation Triple A-(mm) | Individual result Dry at 23 ± 2° C. | 8.8 | — |
| Water Permeability (mm/h) | EN 12616 | 60000 | ≥500 |
| Horizontal water flow | ESTO Guideline | 0.388 | |

TABLE 1-continued

| Property | Test Condition | Result | Requirement ESTO Guide |
|---|---|---|---|
| (l/s.m) | 0.1% Slope | | |
| | 0.3% Slope | 0.645 | |
| | 0.5% Slope | 0.800 | |
| Tensile Strength (MPa) | Unaged EN 12230 | 0.18 | ≥0.15 |
| | After Air Ageing EN 13817/EN 12230 | 0.19 | |
| Tensile Properties % of unaged value (%) | — | 105 | ≥75% |

It can be seen in Table 1 that the support layer complies with the Guidelines of the ESTO Performance Guide for Shockpads.

Moreover, this support layer complies with the European EN 15330-1 standard and the latest FIFA Quality Concept for Artificial Turf. This support layer shows improved water drainage when compared to support layers not having the elevated portions and widened drainage holes having a widened entrance portion; furthermore, the shock absorption is uniform over the whole are of this support layer.

The different properties of the support layer according to the invention are measured or calculated under the following conditions.

The thickness and the mass are measured according to EN 9863-1 (CSN EN ISO 9863-1: Geosynthetics—Determination of thickness at specified pressures of 2016). The density is calculated from the mass.

The Shock absorption is measured according to the Guidelines of the ESTO at 23±2° C. and when the sample, i.e. the shockpad, is frozen, for example at a temperature ≤0° C.

The vertical deformation is measured with a dry sample at 23±2° C. The water permeability is measured according to EN 12616 (CSN EN 12616; Surfaces for sports areas—Determination of water infiltration rate.)

The Horizontal water flow is measured according to ESTO Guidelines at three different slopes, e.g. 0.1%, 0.3% and 0.5%.

The Tensile strength is measured for an unaged sample according to EN 12230, whilst for a sample after air ageing is measured according to EN 13817/EN 12230 (DIN EN 12230: Surfaces for sports areas—Determination of tensile properties of synthetic sports surfaces). The Tensile properties are further given by the percentage of unaged value; this is calculated according to the ESTO Guidelines.

In an embodiment the support layer according to the invention has a shock absorption, measured according to the ESTO Guidelines, at 23±2° C. higher than 25%, preferably higher than 50%, more preferably higher than 80%, for example higher than 90%.

In an embodiment the support layer according to the invention has a shock absorption, measured according to the ESTO Guidelines, when said support layer is frozen, for example at a temperature 0° C., higher than 25%, preferably higher than 50%, more preferably higher than 80%, for example higher than 90%.

In an embodiment the support layer according to the invention has a water permeability, measured according to EN 12616, higher than 500 mm/h, preferably higher than 1000 mm/h, more preferably higher than 10000 mm/h, even more preferably higher than 50000 mm/h; for example, 60000 mm/h.

In an embodiment an unaged support layer according to the invention has a tensile strength, measured according to EN 12230, of at least 0.15 MPa, preferably, higher than 0.15 MPa, more preferably higher than 0.16 MPa, for example, 0.18 MPa.

In an embodiment a support layer according to the invention and after air ageing has a tensile strength, according to EN 13817/EN12230, of at least 0.15 MPa, preferably, higher than 0.15 MPa, more preferably higher than 0.16 MPa, for example, 0.19 MPa.

Thus, relative to a reference level 24 of the upper side 2, the slope of the arms 18 starts at this level 24 and slopes down to a lower level 25, at which level 25 the entrance portion 18 transitions into the main, circular, portion 19 of the hole. Also, the pyramid shaped elevations 14 start at the reference level 24 and rise to a top level 27. Consequently, the upper side 2 has flat surface portions 28 between elevated portions 14 and (entrance portions 18 of) holes 6. The shorter the arms 18 are, the larger the flat portions 28 will be. The flat portions 28 thus transition into, bottom surfaces of, the arms 18, in the example of the figures, as shown in FIG. 4, at an angle of about 20 degrees, in the direction 15, and transition into upwardly sloped surfaces of the pyramid shape of elevations, at an angle of about 10 degrees, transverse to the direction 15. Also see FIG. 12.

An elevation e of each elevated portion 12 is about 3 mm. A maximum thickness t of the support layer 1 is about 25 mm. Also, the polymeric foam has a material density of between 30 and 50 gram per liter, such as between 30 and 40 gram per liter. Also, the polymeric foam of which the support layer 1 is made, is a polyethylene foam.

The impact characteristics are measured using standardized testing procedures, such as for example but not limited to ASTM-F355 in the U.S. and EN-1177 in Europe and FIFA 2015 FQP test methods e.g. FIFA test methods 04a, 05a, 13. For example for soccer fields, the FIFA provides strict rules regarding impact that the artificial turf system has to comply to. The present support layer complies with the latest FIFA (Federation Internationale de Football Association) Quality Concept for Artificial Turf, the International Artificial Turf Standard (IATS) and the European EN15330 Standard. Typical shock, or energy, absorption and deformation levels from foot impacts far such systems are within the range of 55-70% shock absorption and about 4 millimeters to about 9 millimeters deformation, when tested with the Berlin Artificial Athlete (EN14808, EN14809). Vertical ball rebound is about 60 centimeters to about 100 centimeters (EN12235), Angled Ball Behavior is 45-70%, Vertical Permeability is greater than 180 mm/hr (EN12616) along with other standards, such as for example energy restitution.

The support layer according to the invention may be in the form of a panel or plate several of which are used together to cover the base layer forming a ground-covering support system. The plates or panels according to the invention may be configured to have a puzzle-shape, such as by dovetail shaped joints as mentioned below, allowing interlocking connection to obtain a support system that is stable and does not have shifting of the separate support panels relative to each other.

Figure 8:
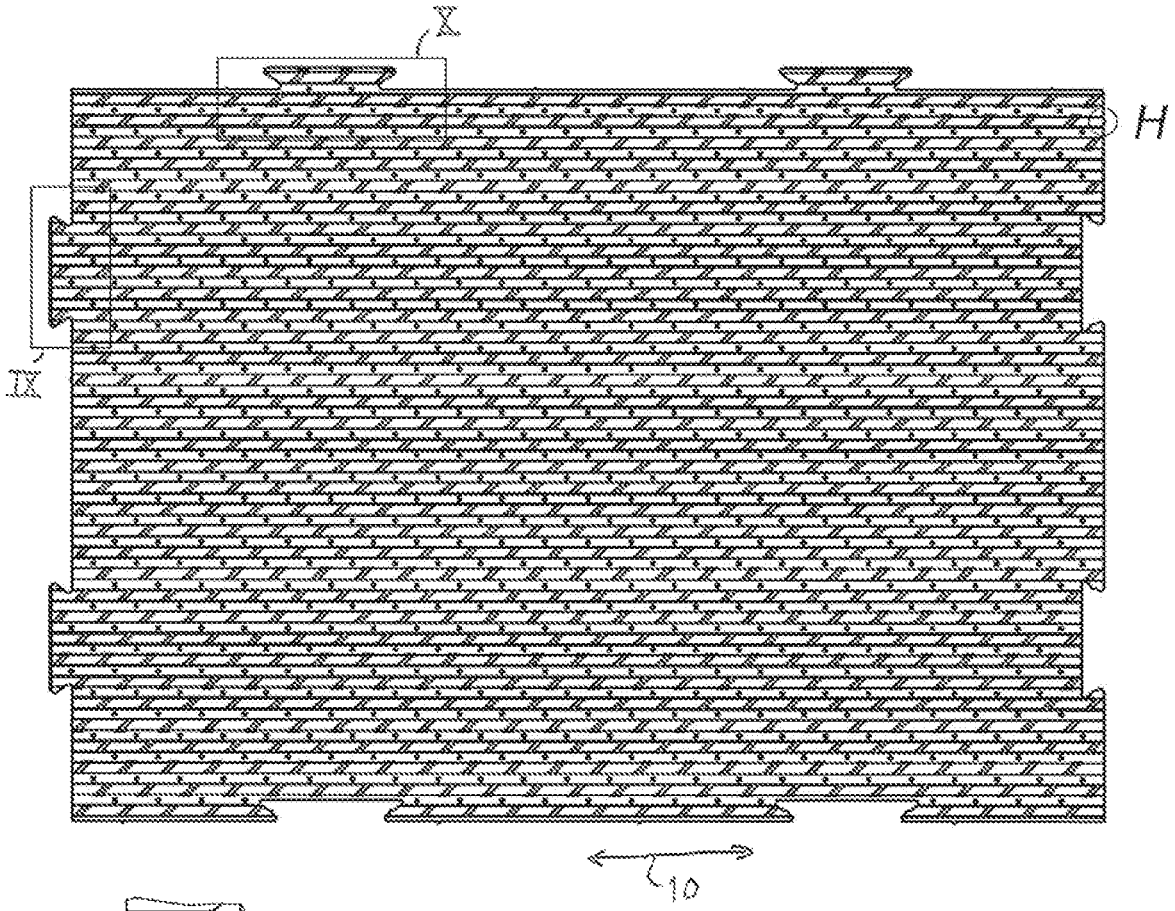
FIG. 8 shows, in bottom view, the support layer of FIG. 1.
Figure 9:
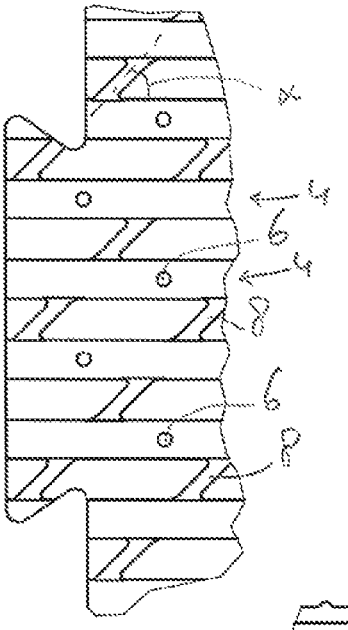
FIG. 9 shows detail IX of FIG. 8.
Figure 10:
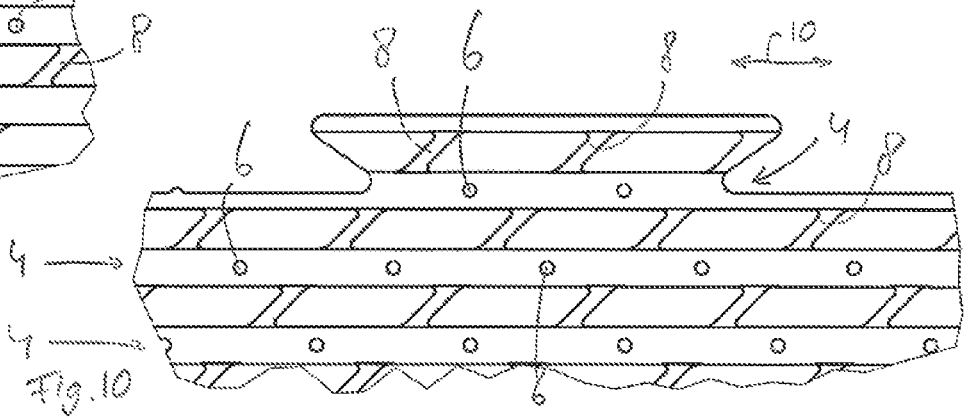
FIG. 10 shows detail X of FIG. 8.
Figure 12:
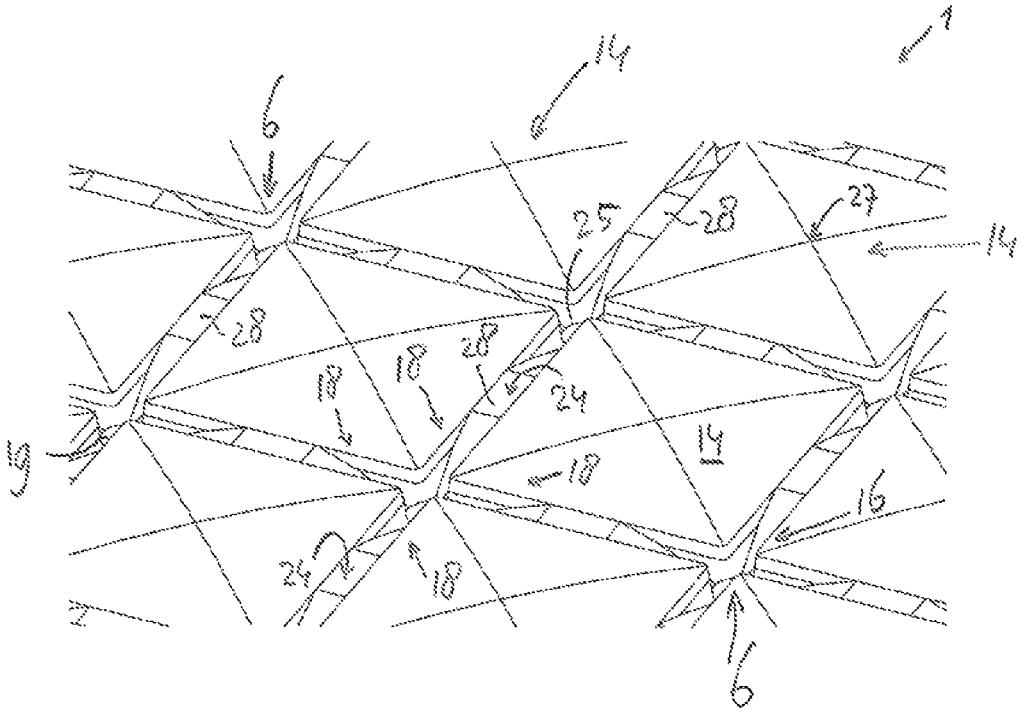
FIG. 12 shows, in 3-dimensional view, a part of an upper side of the support layer of FIG. 1.

As FIGS. 1 and 8 show in particular, the support layer 1 is of a generally rectangular shape and has connecting elements at a circumferential edge 37 thereof, in the form of dovetail joints 36*a* & 36*b*, for connecting the support layer 1 to further such support layers 1 and such that the connected support layers 1 are flush with respect to each other and form a closed surface for supporting thereon the artificial turf assembly 30. As shown, the layer 1 has male dovetail joints 36*a* on its left and bottom side in the view of FIG. 1, and has female dovetail joints 36*b* on its right and upper side in the view of FIG. 1. This way, the layer 1 can be easily and in a form closed manner be connected to further of such layers 1.

Figure 13:
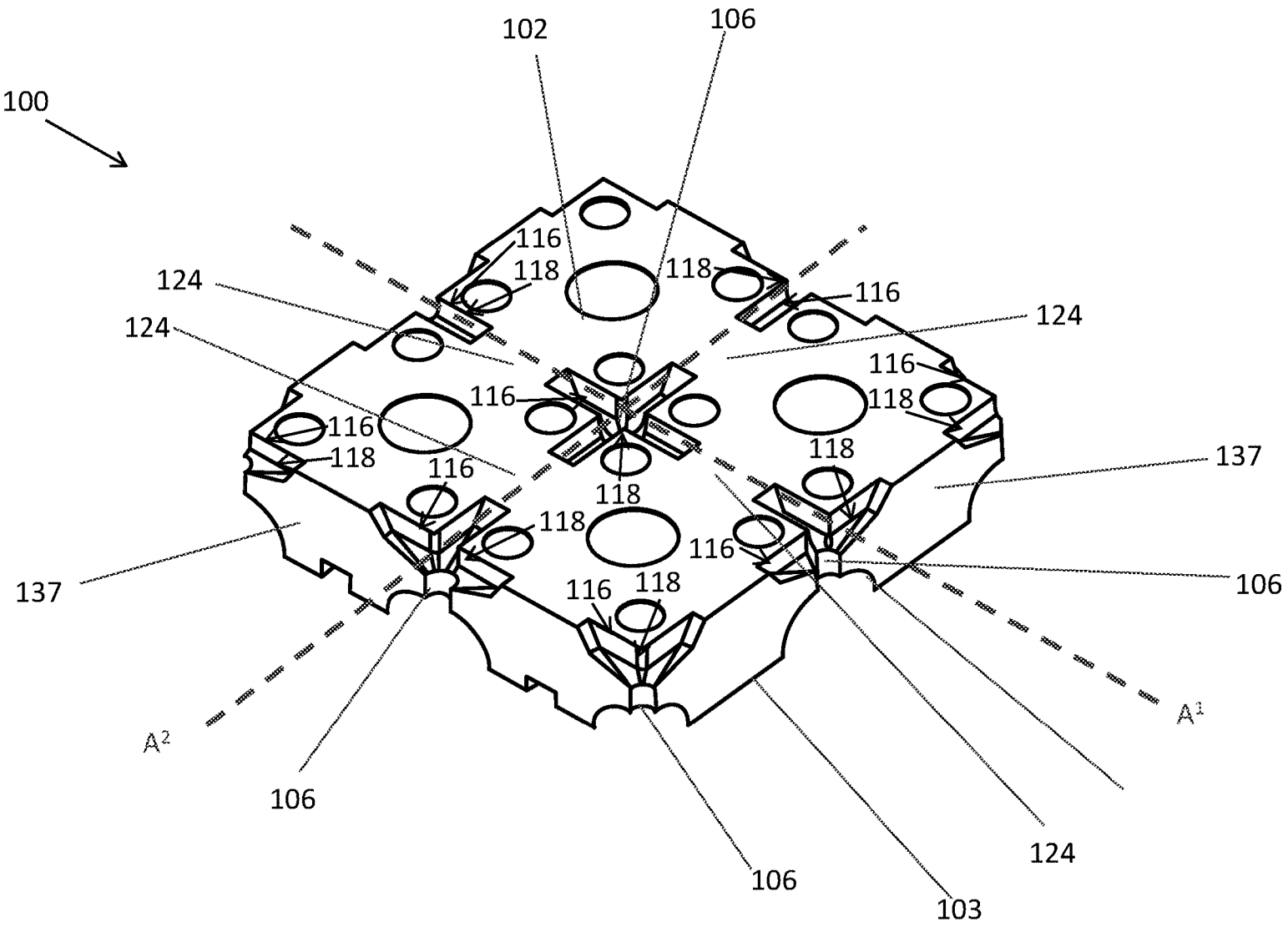
FIG. 13 shows a perspective view of a second embodiment of the support layer.
Figure 14:
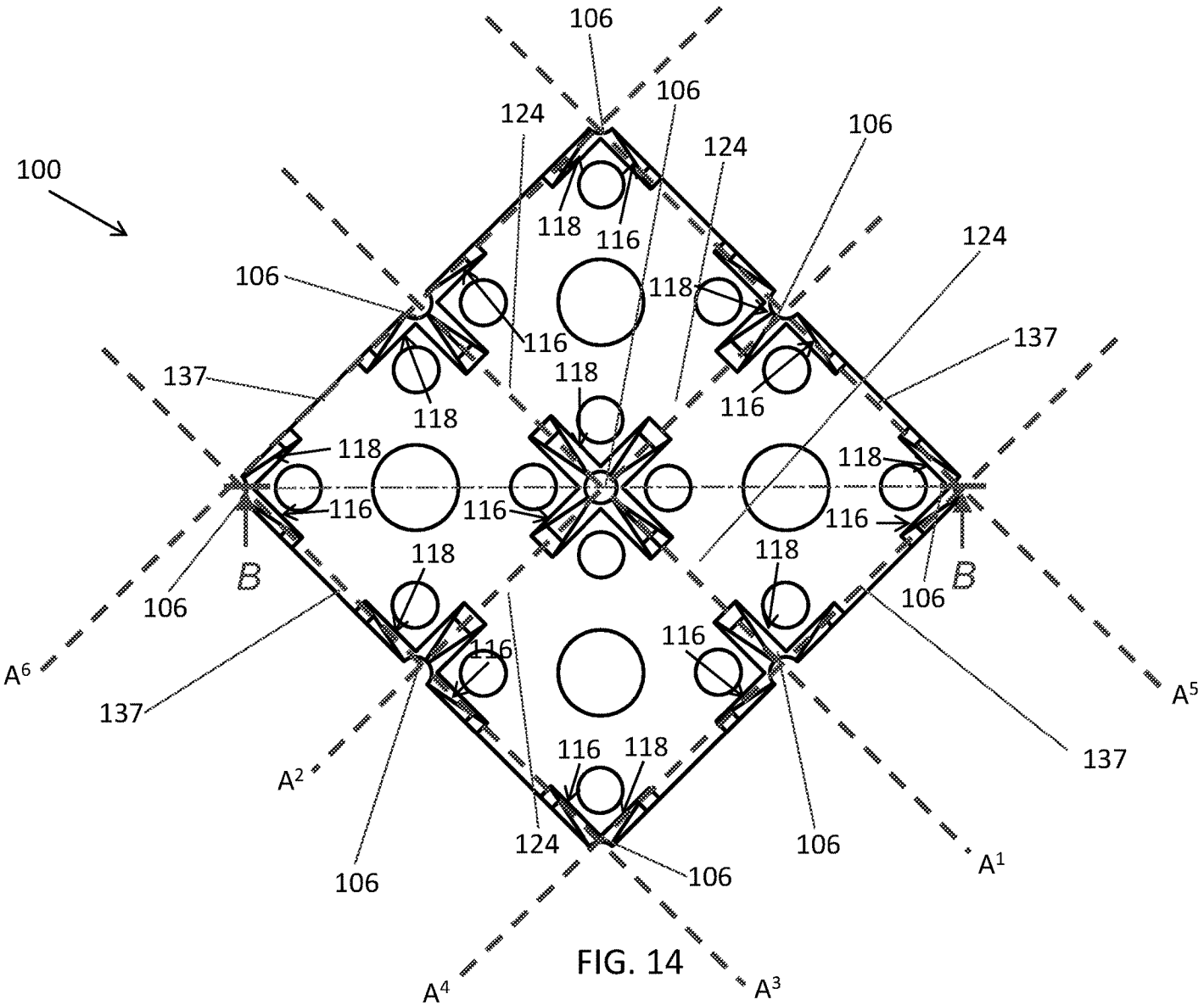
FIG. 14 shows a top view of the second embodiment of the support layer.
Figure 15:
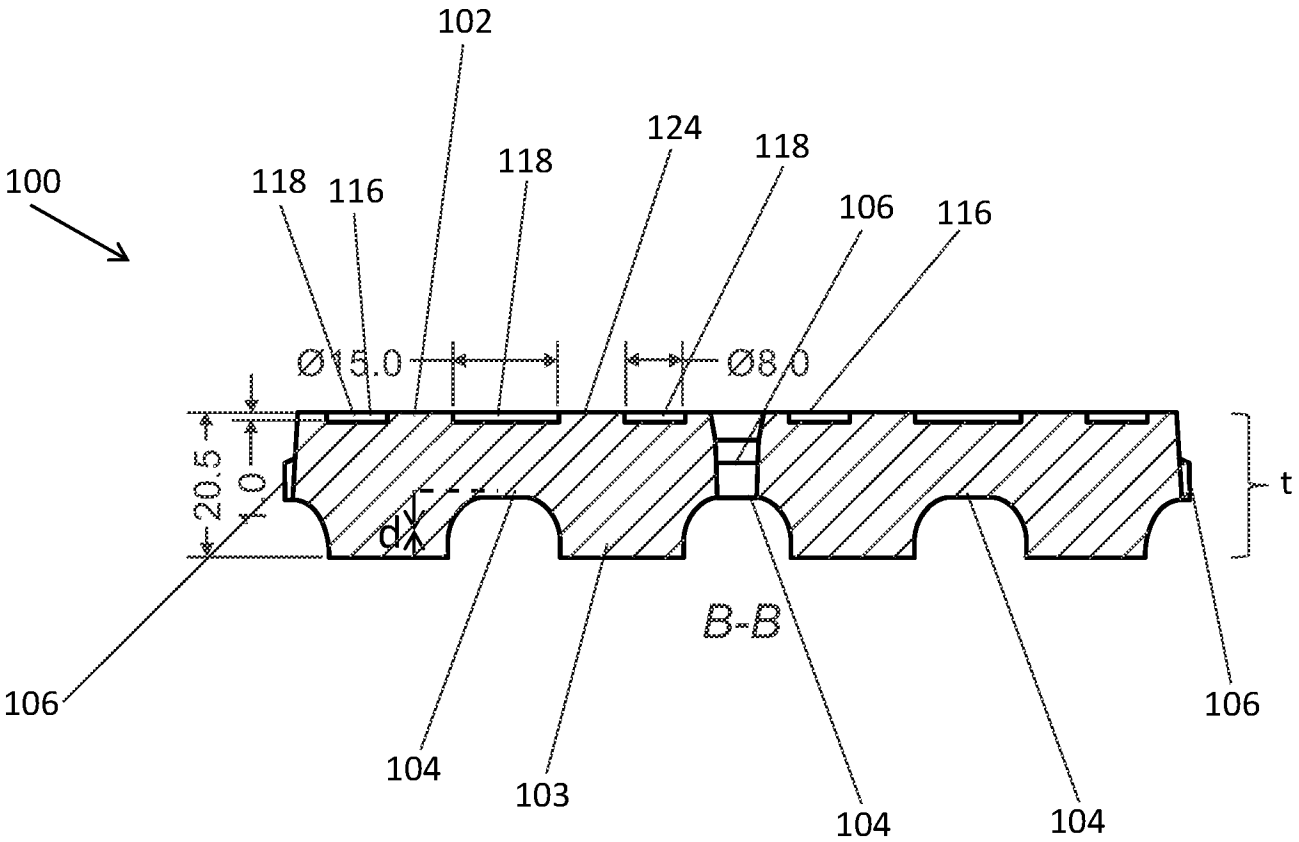
FIG. 15 shows section B-B of FIG. 14.

FIGS. 13-15 depict a second embodiment of the support layer(s) 100 as disclosed herein. In particular. FIG. 13 depicts a perspective view of a second embodiment of the support layer 100, FIG. 14 shows a top view of the second embodiment of the support layer 100, and FIG. 15 shows section B-B of the support layer 100 of FIG. 14. The support layer 100 of the second embodiment may be made from substantially the same materials, in substantially the same way, and performs in a substantially similar manner as that mentioned above regarding the first embodiment (i.e., support layer 1). Furthermore, the lower side 103 of the support layer 100 including the channels 104 formed thereon of the second embodiment may have substantially the same conformation as disclosed above in FIGS. 2-5, and 8 when disclosing the first embodiment.

Figure 11:
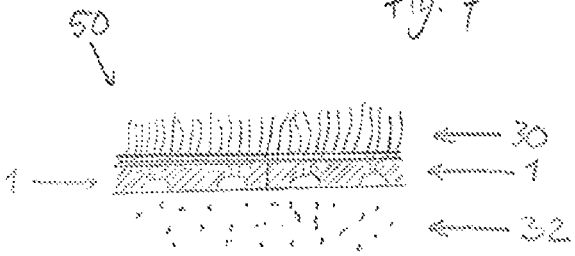
FIG. 11 shows an artificial turf system according to the present invention.

Also, similar to the first embodiment and in view of FIG. 11, the second embodiment of the support layer 100 may be arranged for supporting an artificial turf assembly 30 while in use. In view of FIG. 11, support layer 100 may be included within system 50 instead of support layer 1 (i.e., support layer 100 may be substituted for support layer 1 in system 50). In this aspect and in view of FIG. 11, the support layer 100 of the second embodiment is part of a plurality of such support layers 100 of a support system 50 according to FIG. 11, the system 50 further comprising an artificial turf assembly 30, that means, an assembly forming a surface of synthetic fibers made to look like natural grass, most often used in sports arenas but for residential lawns as well. The plurality of support layers 100 is then supported on a base surface 32 such as a layer of sand, and form, at upper sides 2 thereof, a closed support surface supporting the artificial turf assembly 32.

In view of FIGS. 11, 13, and 14, the support layer 100 is in the form of a rectangular support plate element formed of a polymeric foam and has an upper side 102 and a lower side 103, wherein, as mentioned above, when in use the support layer 100 has been placed with the lower side 103 thereof on a base surface and supports, on the upper side 102 thereof, the artificial turf assembly. In certain aspects, a length of the layer 100 ranges from about 1.4 m to 1.6 m and a width ranges from about 1.10 to 1.15 m. In certain aspects, a length of the layer 100 is about 1.58 m and a width ranges is about 1.12 m.

In certain aspects and as further shown in FIGS. 13 and 14, each support layer 100 includes at least partial drainage holes 106 formed on the circumferential edges (peripheral edges) 137 (including the corners) of the support layer 100, and as further shown in FIGS. 14 and 15, the support layer 100 further includes a complete drainage hole formed approximately in the center of each support layer 100. Each drainage hole 106 has a predetermined shape. For example, in certain preferred aspects, the partial drainage holes are semi-circular shaped (half circles) while the complete drainage hole is preferably circular shaped. It should be further noted that each partial drainage hole 106 formed on the circumferential edges (peripheral edges) 137 is configured to form complete drainage holes when one or more support layer(s) 100 are assembled and/or connected to another support layer. For example and in view of FIGS. 13 and 14, it should be readily appreciated and understood, that four support layers 100 should be aligned and connected to one another to form a complete drainage hole from the partial drainage holes 106 formed on a corner of the support layer(s) 100. Likewise, only two support layers 100 need to be aligned and connected to one another when forming a complete drainage hole 106 positioned approximately mid-span along each of the circumferential edges 137 (peripheral edges) of each support layer.

In view of the above and FIGS. 13-15, it should be further appreciated that the upper side 102 of each support layer 100 is generally planar (i.e., unlike the first embodiment does not include elevated portions) but may be slightly sloped to direct water towards each partial and/or complete drainage hole 106 formed on the support layer 100, which further facilitates water drainage from the upper side 102 of each support layer to the lower side 103 of each support layer via the drainage holes 106. In further view of FIGS. 13-15, the upper side 102 of each support layer 100 further includes a widened entrance portion 116 (similar to widened entrance portion 16 in FIG. 4 of the first embodiment) directly adjacent to and surrounding each partial and complete drainage hole 106 formed on each support layer 100. The widened entrance portion 116 preferably has a predetermined shape, which includes a star shape or a cross shape 118 when formed in the center of the support layer 100 (or at least a partial cross shape 118 when formed along the circumferential edges of each support). The cross shape 118 (or partial cross shape 118 formed along the circumferential edges of each support) include individual arms. Each individual arm begins and is directly connected to the uppermost surface of the upper side 102 and continuously descends/extends with a constant slope (or substantially constant slope) towards and is directly connected to its corresponding complete or partial drainage hole 106. This arrangement further facilitates water drainage from the upper side 102 (e.g., an uppermost surface) of the support layer 100 through the drainage hole into the lower side 103 of the support layer.

As further shown in FIGS. 13 and 14 and with reference to a first axis ($A^1$) and a second axis ($A^2$), the arms of the cross shape 118 (or partial cross shape 118) of the widened entrance portions 116 are axially aligned along a first or second axis with arms of other cross shapes (or partial cross shapes 118) formed on the upper side 102 of the support layer. (The third through sixth axes (i.e., $A^3$, $A^4$, $A^5$, $A^6$), as shown in FIG. 14, similarly depict additional, contemplated axial alignments of each arm positioned along the circumferential edges in the support layer 100.) Although each arm of the cross shape (or partial cross shape) is axially aligned with another arm of another cross shape (or partial cross shape) formed on the upper side 102 of the support layer 100, these axially aligned arms are not fluidly connected to one another. Instead, each axially aligned arm is separated by reference portion 124, which is part of the upper most (or outermost) portion of upper side 102 and is substantially planar and/or is slightly sloped towards each arm that it separates. Thus, in this aspect reference portion 124 separates an arm from another arm but further directs water flow towards a desired arm and ultimately the desired drainage hole 106 (i.e., complete or partial drainage hole) of each support layer 100.

FIG. 15 further depicts a cross section of support layer 100 of B-B of FIG. 14. In view of FIG. 15 and the above disclosures, it should be readily apparent how the upper side 102, widened entrance portion(s) 116, and cross-shape(s) (and/or partial cross shapes) 116 direct water towards drainage holes 106 (or partial drainage holes) and how water is directed into at least one of the plurality of channels 104 formed on the lower side 103 of the support layer 100. In FIG. 15, "d" represents the depth of each channel 104 formed on the lower side 103, which is about 50 percent of a total thickness "t" of the layer 100. It should be noted that the thickness of the support layer 100 range from 10 to 80 mm, from 10 to 70 mm, from 15 to 70 mm, from 10 to 65 mm, from 15 to 65 mm, from 10 to 60 mm, from 15 to 60 mm, from 10 to 55 mm, from 15 to 55 mm, from 10 to 50 mm, from 15 to 50 mm, from 10 to 45 mm, from 15 to 45 mm, wherein any of the endpoints falling within the above disclosed ranges may serve as endpoints for any additional range(s) falling there between (but not explicitly disclosed above).

As discussed above, the support layer 100 shown in FIGS. 13-15 may be in the form of a panel or plate, and in view of FIG. 11, several support layers may be connected and used together to cover the base layer forming a ground-covering support system 50. The plates or panels according to the invention may be configured to connect to one another and may have a puzzle-shape, such as by dovetail shaped joints, allowing interlocking connection to obtain a support system that is stable and does not have shifting of the separate support panels relative to each other. The support layer 100 is of a generally rectangular shape and has connecting elements (not shown) positioned on and/or extending from circumferential edge(s) 137 thereof; these connecting elements may be in the form of dovetail joints, for connecting the support layer 100 to another support layer 100 and such that the connected support layers 100 are flush with respect to each other and form a closed surface for supporting thereon the artificial turf assembly 30. In certain aspects, the layer 100 may have male dovetail joints on its left and/or bottom side, and may have female dovetail joints on its right and/or upper side such that multiple support layers can be easily connected to one another to achieve a desired overall dimension.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope thereof.

The following clauses define several aspects and embodiments of the invention.

1. A support layer (1, 100) for supporting an artificial turf assembly (30), said support layer being formed of a polymeric foam and having an upper side (2, 102) and a lower side (3, 103), wherein in use the support layer (1) has been placed with the lower side (3, 103) thereof on a base surface and supports, on the upper side (2, 102) thereof, the artificial turf assembly, the support layer (1, 100) comprising a plurality of through drainage holes (6, 106) extending from the upper side (2, 102) to the lower side (3, 103) for allowing liquid such as rain water to flow via the plurality of drainage holes (6, 106) from the upper side (2, 102) to the lower side (3, 103), and also comprising a plurality of channels (4, 104) at the lower side (3, 103) for allowing liquid such as rain water to flow through the channels (4, 104) along the lower side (3, 103), wherein each of said plurality of drainage holes (6, 106) debouches into one of the plurality of channels (4, 104), wherein said support layer (1, 101) comprises a plurality of individual elevated portions (14—first embodiment only) at the upper side (2) of the support layer (1) and said plurality of individual elevated portions (14) are dome, pyramid, truncated pyramid, cone, truncated cone or tetrahedron shaped, preferably, pyramid or dome shaped.

2. A support layer (1, 100) for supporting an artificial turf assembly (30), said support layer being formed of a polymeric foam and having an upper side (2, 102) and a lower side (3, 103), wherein in use the support layer (1, 100) has been placed with the lower side (3, 103) thereof on a base surface and supports, on the upper side (2, 102) thereof, the artificial turf assembly, the support layer (1, 101) comprising a plurality of through drainage holes (6, 106) extending from the upper side (2, 102) to the lower side (3, 103) for allowing liquid such as rain water to flow via the plurality of drainage holes (6, 106) from the upper side (2, 102) to the lower side (3, 103), and also comprising a plurality of channels (4, 104) at the lower side (3, 103) for allowing liquid such as rain water to flow through the channels (4, 104) along the lower side (3, 103), wherein each of said plurality of drainage holes (6, 106) debouches into one of the plurality of channels (4, 104); and wherein drainage holes (6, 106), preferably each drainage hole, of the plurality of drainage holes have a widened entrance portion (16 or arms 118) at the upper side (2, 102) of the support layer (1, 101).

3. A support layer (1, 100) for supporting an artificial turf assembly (30), said support layer being formed of a polymeric foam and having an upper side (2, 102) and a lower side (3, 103), wherein in use the support layer (1, 101) has been placed with the lower side (3, 103) thereof on a base surface and supports, on the upper side (2, 102) thereof, the artificial turf assembly, the support layer (1, 100) comprising a plurality of through drainage holes (6, 106) extending from the upper side (2, 102) to the lower side (3, 103) for allowing liquid such as rain water to flow via the plurality of drainage holes (6, 106) from the upper side (2, 102) to the lower side (3, 103), and also comprising a plurality of channels (4, 104) at the lower side (3, 103) for allowing liquid such as rain water to flow through the channels (4, 104) along the lower side (3, 103), wherein each of said plurality of drainage holes (6, 106) debouches into one of the plurality of channels (4, 104), wherein said support layer (1, 101) comprises a plurality of individual elevated portions (14—first embodiment only) at the upper side (2, 102) of the support layer (1, 100) and said plurality of individual elevated portions (14) are dome, pyramid, truncated pyramid, cone, truncated cone or tetrahedron shaped, preferably, pyramid or dome shaped; and wherein drainage holes (6), preferably each drainage hole, of the plurality of drainage holes have a widened entrance portion (16 or arms 118) at the upper side (2, 102) of the support layer (1, 100).

The foregoing description provides embodiments of the invention by way of example only. The scope of the present invention is defined by the appended claims. One or more of the objects of the invention are achieved by the appended claims.

The invention claimed is:

1. A support layer for supporting an artificial turf assembly, said support layer comprising a polymeric foam; and having an upper side and a lower side, wherein the lower side of the support layer is configured for placement on a base surface and the upper side is configured to support the artificial turf assembly thereon, the support layer comprising a plurality of through drainage holes extending from the upper side to the lower side for allowing liquid to flow via the plurality of drainage holes from the upper side to the lower side, and also comprising a plurality of channels at the lower side for allowing liquid to flow through the channels along the lower side, wherein each of said plurality of drainage holes debouches into one of the plurality of channels, and wherein the upper side of the support layer is substantially planar and includes sloped or recessed portions formed thereon that are angled and extend towards a drainage hole of the plurality of drainage holes to facilitate drainage from the upper side of the support layer to the lower side of the support layer, and wherein each drainage hole is arranged immediately adjacent to an arm formed on the upper side of the support layer that is configured to direct water towards the drainage hole, each arm is spaced apart from and discontinuous relative to another arm that is immediately adjacent to another drainage hole formed on the upper side of the support layer.

2. The support layer according to claim 1, wherein the plurality of channels extend mutually parallel and are fluidly connected to each other by a plurality of cross channels.

3. The support layer according to claim 2, the plurality of cross channels have a smaller cross sectional area than the plurality of channels.

4. The support layer according to claim 2, wherein the plurality of channels extend in a length direction of the support layer, the plurality of cross channels extending, mutually parallel, at an angle (a) ranging from 20 to 90 degrees relative to the length direction.

5. The support layer according to claim 1, wherein the drainage holes have a widened entrance portion at the upper side of the support layer.

6. The support layer according to claim 5, wherein each drainage hole is surrounded by a widened entrance portion that is star-shaped or cross-shaped in plan view.

7. The support layer of claim 5 wherein the arms from each widened entrance portion are axially aligned with arms from another widened entrance portion but are spaced apart and are not fluidly connected to one another on the upper side of the support layer.

8. The support layer according to claim 1, wherein a maximum thickness of the support layer ranges from 10 to 80 mm.

9. The support layer according to claim 1, wherein a thickness of the support layer ranges from 20 to 80 mm.

10. The support layer according to claim 1, wherein a thickness of the support layer ranges from 20 to 65 mm.

11. The support layer according to claim 1, wherein a depth of the plurality of channels ranges from 25 to 75 percent of a total thickness of the support layer.

12. The support layer according to claim 1, further comprising connecting elements at a circumferential edge thereof for connecting the support layer to further support layers such that the support layers are flush with respect to each other.

13. An artificial turf system, comprising an artificial turf assembly, and a support layer according to claim 1, supported on a base surface, wherein:

the support layer forms, at the upper sides thereof, a closed support surface supporting the artificial turf assembly.

14. A support layer for supporting an artificial turf assembly, said support layer comprising a polymeric foam; and having an upper side and a lower side, wherein the lower side of the support layer is configured for placement on a base surface and the upper side is configured to support the artificial turf assembly thereon, the support layer comprising a plurality of through drainage holes extending from the upper side to the lower side for allowing liquid to flow via the plurality of drainage holes from the upper side to the lower side, and also comprising a plurality of channels at the lower side for allowing liquid to flow through the channels along the lower side, wherein each of said plurality of drainage holes debouches into one of the plurality of channels, and wherein the upper side of the support layer is substantially planar having a plurality of widened entrance portions, each widened entrance portion having a plurality of arms adjacent to and sloped towards a drainage hole of the plurality of drainage holes, with each arm of one widened entrance portion being spaced apart and discontinuous relative to another arm of another widened entrance portion, and the arms from each widened entrance portion being axially aligned with arms from another widened entrance portion but spaced apart and not fluidly connected to one another on the upper side of the support layer.

15. The support layer according to claim 14, wherein the plurality of channels extend mutually parallel and are fluidly connected to each other by a plurality of cross channels.

16. The support layer according to claim 15, the plurality of cross channels have a smaller cross sectional area than the plurality of channels.

17. The support layer according to claim 15, wherein the plurality of channels extend in a length direction of the support layer, the plurality of cross channels extending, mutually parallel, at an angle ($\alpha$) ranging from 20 to 90 degrees relative to the length direction.

18. The support layer according to claim 14, wherein the substantially planar upper side of the support layer has sloped or recessed portions formed on the upper side of the support layer that are angled and extend towards a drainage hole of the plurality of drainage holes to facilitate drainage from the upper side of the support layer to the lower side of the support layer.

19. The support layer according to claim 14, wherein each drainage hole is immediately adjacent to an arm that is formed on an upper side of the support layer and is configured to direct water towards the drainage hole.

20. The support layer according to claim 14, wherein each drainage hole is surrounded by a widened entrance portion that is star-shaped or cross-shaped in plan view.

21. The support layer according to claim 14, wherein a maximum thickness of the support layer ranges from 10 to 80 mm.

22. The support layer according to claim 14, wherein a thickness of the support layer ranges from 20 to 80 mm.

23. The support layer according to claim 14, wherein a thickness of the support layer ranges from 20 to 65 mm.

24. The support layer according to claim 14, wherein a depth of the plurality of channels ranges from 25 to 75 percent of a total thickness of the support layer.

25. The support layer according to claim 14, further comprising connecting elements at a circumferential edge thereof for connecting the support layer to further support layers such that the support layers are flush with respect to each other.

26. An artificial turf system, comprising an artificial turf assembly, and a support layer according to claim 14, supported on a base surface, wherein:

the support layer forms, at the upper sides thereof, a closed support surface supporting the artificial turf assembly.

* * * * *